United States Patent [19]

Sassmannshausen

[11] 4,110,658

[45] Aug. 29, 1978

[54] ELECTRIC INCANDESCENT LAMP

[76] Inventor: Knut Otto Sassmannshausen, 5, Pinewood Estate, Wexford, Ireland

[21] Appl. No.: 749,061

[22] Filed: Dec. 9, 1976

[30] Foreign Application Priority Data

Dec. 17, 1975 [IE] Ireland ..... 2749/75

[51] Int. Cl.[2] ..... H01J 1/16; H01K 1/14; H01J 19/10

[52] U.S. Cl. ..... 313/344; 313/341

[58] Field of Search ..... 313/341, 342, 343, 344

[56] References Cited

U.S. PATENT DOCUMENTS 2,060,506 11/1936 Knowles ..... 315/342

*Primary Examiner*—Alfred E. Smith
*Assistant Examiner*—David K. Moore
*Attorney, Agent, or Firm*—Herbert L. Lerner

[57] ABSTRACT

An electric incandescent lamp having a rotational axis, includes a filament formed with a coil disposed in bowed form across the axis of the lamp, the length CL of the coil, measured along the mean curvature ML of the coil, being 3.6 to 6.2 times greater than the outside diameter OD of the coil and the height H of the coil, measured in the direction of the axis of the lamp, being 1.2 to 2.5 times greater than the outside diameter of the coil, and the distance A between each of the windings of the filament of the coil, measured along the mean curvature ML of the coil, being 0.3 to 1.2 times as great as the diameter WD of the filament of the coil.

14 Claims, 3 Drawing Figures

ELECTRIC INCANDESCENT LAMP

The invention relates to electric incandescent lamps with a coiled filament. Such electric incandescent lamps are often used in reflectors especially in small reflectors and the light center of the coil of the lamps is located at the focal point or focal space of the reflector. Generally, the reflectors have a parabolic or substantially parabolic shape.

The reflector is intended to collect the light radiating from the coil and project it as a parallel beam. This presupposes that the coil has the shape of a point in a mathematical sense. It is not possible to create such a coil, however, for the coil consists of a filament and the length and the diameter of the filament depends upon the needed voltage and/or current. It is well-known to coil the filament, which usually is a tungsten wire or a carbon filament. There have been attempts to reduce the linear extent of the light source in comparison, for example with the size of the reflector of a flashlight, by coiling the filament. But the linear extent of the coil remained too large. It has also been known heretofore to construct the coil in the shape of an end view of a gable roof or in the shape of a hairpin in order to get to the ideal of a mathematical point as closely as possible.

These two previously attempted solutions have the disadvantage that, because of the very sharp bend in the upper part of the coil, the distance between the windings of the filament of the coil has to be very large in order to avoid short circuits between the windings at the inside of the bend of the coil. It has also been known heretofore to construct a coil with a very large outside diameter in order to keep the length of the coil of the same order of magnitude as the diameter of the coil. This attempted solution has the disadvantage that the diameter of the coil becomes very large in comparison with the diameter of the filament of the coil. By having such large diameter, the coil is not stable and the distance between the windings of the coil must again be relatively large.

If the hereinbeforementioned heretofore known coils are located in a parabolic reflector, the amount of divergence of the cone of the beam of the reflector is rather large.

It is accordingly an object of the invention to provide an electric incandescent lamp in a reflector, preferably a small parabolic reflector, with a coil of such construction that a beam projected by the reflector is as parallel as possible.

In order to attain this objective, the idea of creating a coil which is as similar to a mathematical point as possible was discarded, since it was realized that it would be impossible to produce such a coil. Instead of this, all efforts were concentrated upon the objective of finding out the most suitable shape of a coil, so that the coil would produce, in combination with a reflector, a beam that was as parallel as possible. The solution to this problem proved surprising to applicant although it is not always possible to give a precise mathematical interpretation for the solution.

It was noticed, for example, that the linear extent of the coil or light source along the rotational axis of the electric incandescent lamp does much more harm to the parallelism of the beam than an extension of the coil in a plane perpendicular to the rotational axis of the lamp.

Furthermore the results are especially good if the extension of the coil into one of the directions perpendicular to the rotational axis of the lamp is in a mathematically defined way greater than into the other direction, which is in the same plane but perpendicular to the first direction. Furthermore, the coil has to be bent in a particular way.

In the lamp according to the invention, the length CL of the coil of the electric incandescent lamp is 3.6 to 6.2, preferably 4.1 to 5.7, and even more preferably 4.6 to 5.2 times greater than the outside diameter OD of the coil, the length being measured along the mean curvature ML of the coil, the coil being located in a curved manner across the axis of the lamp, and that the height H of the coil is 1.2 to 2.5, preferably 1.5 to 2.2, and even more preferably 1.7 to 2.0 times greater than the outside diameter OD of the coil, the height H being measured in direction of the axis of the lamp, and that the distance A between the windings of the filament of the coil is 0.3 to 1.2, preferably 0.4 to 1.0, and even more preferably 0.5 to 0.9 times as great as the diameter WD of the filament of the coil, the distance A being measured along the mean curvature ML of the coil.

The length CL of the coil, mounted or located in a bowed or curved manner, is the length of the curved oil from the first to the last winding measured along the mean curvature ML. If one or two of the windings at the beginning or end of the coil are coiled with a much greater spacing than the average distance of the other windings, in such case these faulty windings are not to be counted in the length CL of the coil, for such faulty windings do not have illuminating power. Measuring the height H of the coil, such faulty windings also are not to be counted. If technically possible, it is an advantage to produce a coil, which is very accurate at its beginning and end i.e. all the windings at the beginning or end of the coil have the same spacing from each other as that of all the other windings.

The distance or spacing A between the windings of the filament of the coil is to be measured along the mean curvature of the coil. This is the mean distance or spacing A of the windings. That means, if the coil did not have a bent shape but a straight shape, this distance or spacing A would still be the distance or spacing between the windings of such a straight coil.

The parallelism of the light beam projected by the parabolic reflector, is especially good if the length CL of the coil, measured along the mean curvature ML of the coil, is 18 to 36, preferably 20 to 33, and even more preferably 21 to 30 times greater than the diameter WD of the filament of the coil and if the height H of the coil, measured in the direction of the axis of the lamp, is 6 to 15, preferably 7 to 13, and even more preferably 8 to 12 times greater than the diameter WD of the filament of the coil.

It is also of advantage, in accordance with the invention, if the medium curvature ML of the coil is arcuate, forming part of a circle having a radius R, which is 2 to 4 or preferably 2.4 to 3.7 times larger than the outside diameter OD of the coil.

It is also an advantage, according to the invention, if the mean curvature ML of said coil has approximately the shape of the base section or part of a parabola or hyperbola.

Following these determinations of the shape of the coil, it must be taken into consideration that, because of the restoring force of the material of the filament, generally it is not possible to get shapes that are accurate in a mathematical sense, but only approximately the shape of an arc of a circle or a base portion of a parabola or hyperbola.

It is also an additional advantage, in accordance with the invention, to provide a construction wherein the distance or spacing B between the windings of the filament of the coil along the inside of the curvature of the coil is preferably 0.1 to 0.8, or more preferably 0.1 to 0.5 times as great as the diameter WD of the filament of the coil.

Also in accordance with another feature of the invention the coil is disposed symmetrically with respect to the axis of the electric incandescent lamp.

Other features which are considered as characteristic for the invention are set forth in the appended claims.

Although the invention is illustrated and described herein as embodied in an electric incandescent lamp, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
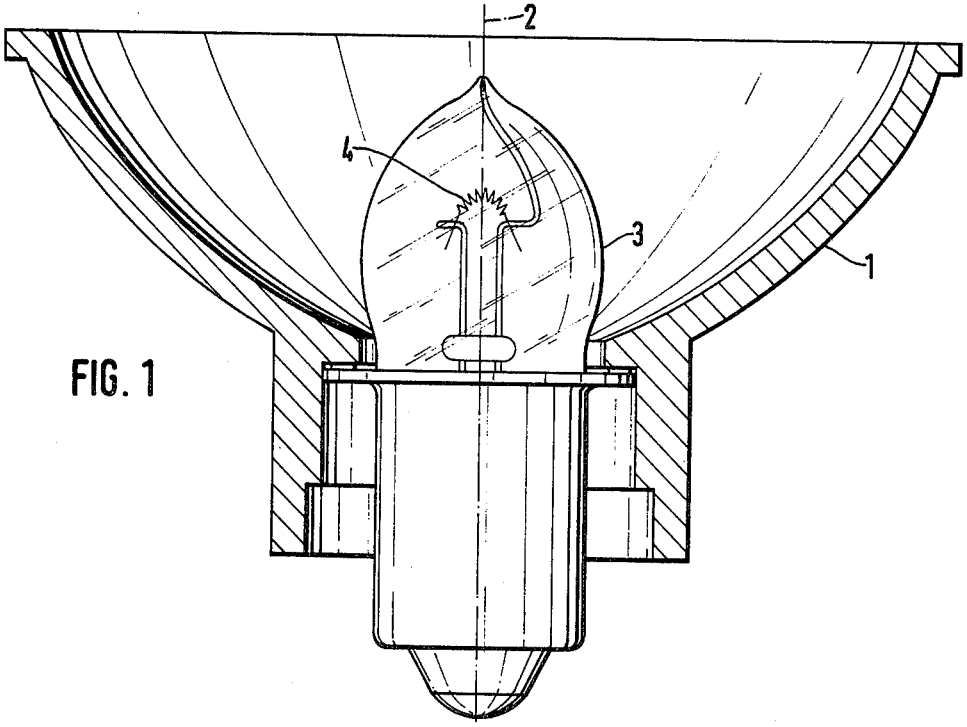
FIG. 1 is a sectional view of a parabolic reflector with an electric incandescent lamp located in the reflector so that the light center of the coil of the lamp filament coincides with the focal point or focal space in the axis of the reflector.
Figure 2:
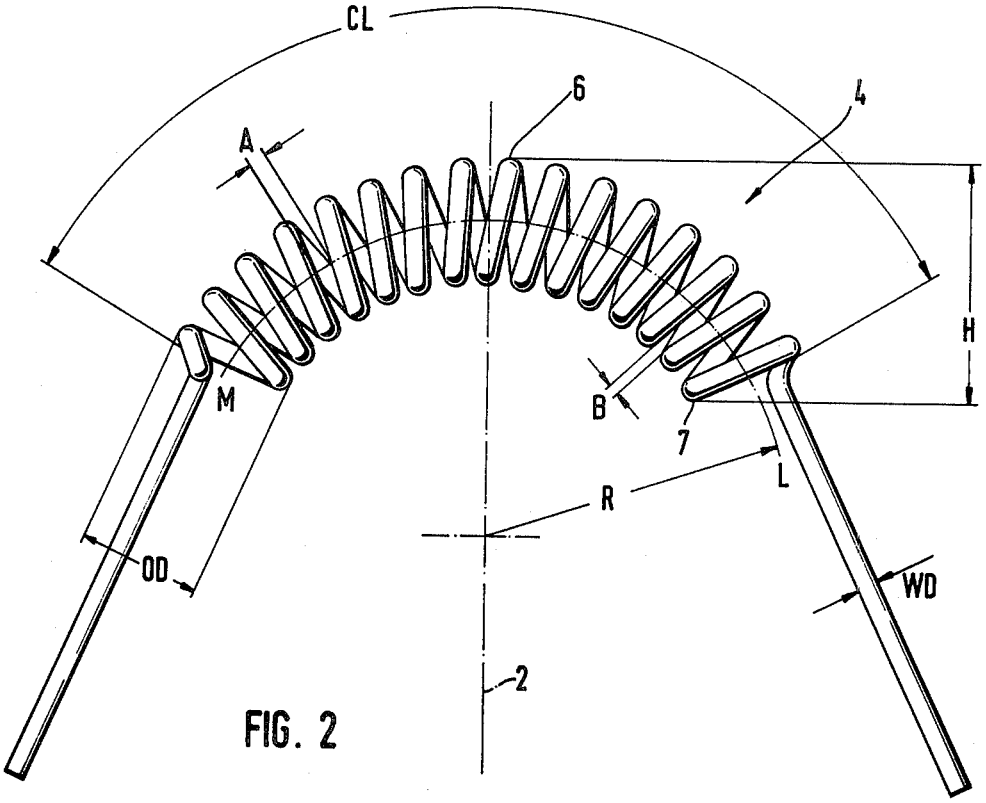
FIG. 2 is a fragmentary enlarged view of FIG. 1 showing the filament coil of the lamp.

The coil 4 is located symmetrically in the rotational axis 2 of the electric incandescent lamp 4 which coincides with the axis of the reflector. The light center of the coil 4 is located at the focal point or focal space of the reflector 1. The mean curvature ML (see FIG. 2) is such that the top of the curvature is directed towards the light emitting opening of the reflector 1, the mean curvature ML having a radius R. The length of the bent coil, measured along the mean curvature ML, is identified as CL.

The height 4 of the coil is measured in the direction of the axis 2 from the beginning of the first winding to the top of the coil. The diameter of the coil is identified as OD. The diameter of the filament is identified as WD.

There are two distances or spacings indicated between the windings of the filament of the coil.

One distance or spacing A is the distance between successive windings of the filament of the coil along the mean curvature ML of the coil.

The second distance or spacing B is the distance between successive windings of the filament of the coil along the inner part of the curvature of the coil.

Figure 3:
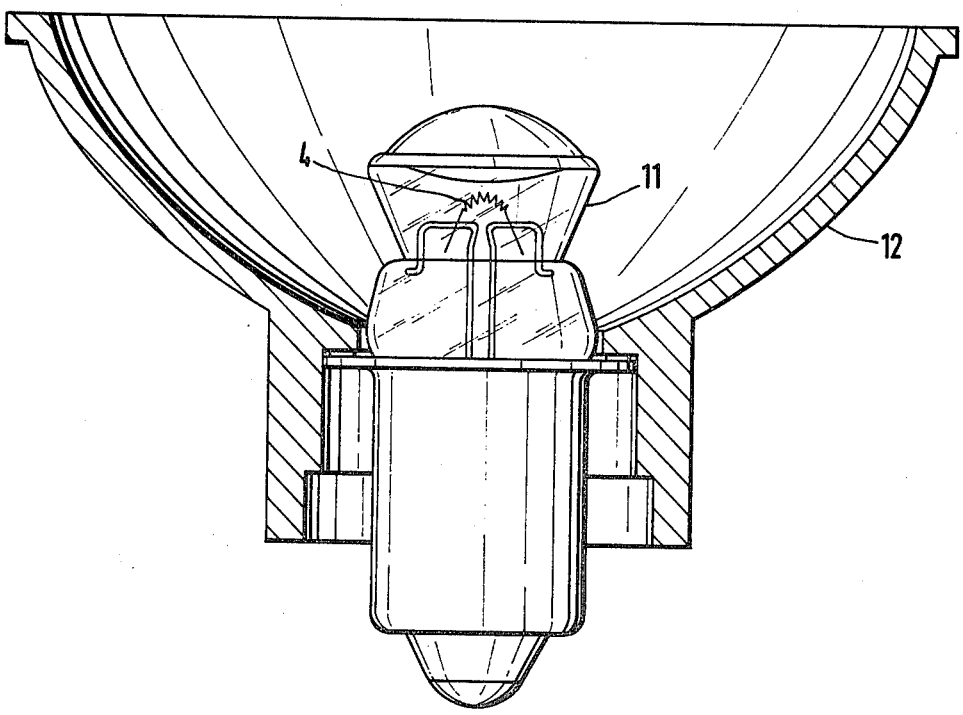
FIG. 3 is a view similar to that of FIG. 1 of another embodiment of the invention.

FIG. 3 shows the coil 4 mounted in a lensed electric incandescent lamp 11 which is inserted into a reflector 12, and the coil 4 is located in the focal point or focal space of the reflector 12.

As noted hereinbefore, the following dimensions of the coiled filament are preferred in order to obtain the advantageous results which are the object of the invention:

$$\frac{\text{Length of coil}}{\text{Outside diameter of coil}} = \frac{CL}{OD} = \text{between 3.6 and 6.2, preferably between 4.1 and 5.7 and, best of all, between 4.6 and 5.2.}$$

$$\frac{\text{Height of coil}}{\text{Outside diameter of coil}} = \frac{H}{OD} = \text{between 1.2 and 2.5, preferably between 1.5 and 2.2 and, best of all, between 1.7 and 2.0.}$$

$$\frac{\text{Space between windings of coil at median curvature ML}}{\text{Diameter of filament}} = \frac{A}{WD} = \text{between 0.3 and 1.2, preferably between 0.4 and 1.0 and, best of all, between 0.5 and 0.9.}$$

$$\frac{\text{Length of coil}}{\text{Diameter of filament}} = \frac{CL}{WD} = \text{between 18 and 36 and preferably between 20 and 33 and, best of all, between 21 and 30.}$$

$$\frac{\text{Height of coil}}{\text{Diameter of filament}} = \frac{H}{WD} = \text{between 6 and 15, preferably between 7 and 13 and, best of all, between 8 and 12.}$$

$$\frac{\text{Radius of medium curvature ML}}{\text{Outside diameter of coil}} = \frac{R}{OD} = \text{between 2 and 4 and preferably between 2.4 and 3.7.}$$

$$\frac{\text{Spacing between coils on inside of curvature of filament}}{\text{Diameter of filament}} = \frac{B}{WD} = \text{between 0.1 and 0.8 and preferably between 0.1 and 0.5.}$$

There are claimed:

1. In an electric incandescent lamp, having a rotational axis, a filament formed with a coil disposed in bowed form across the axis of the lamp, the length CL of said coil, measured along the mean curvature ML of said coil, being 3.6 to 6.2 times greater than the outside diameter OD of said coil and the height H of said coil, measured in the direction of the axis of said lamp, being 1.2 to 2.5 times greater than the outside diameter of said coil, and the distance A between each of the windings of the filament of said coil, measured along the mean curature ML of said coil, being 0.3 to 1.2 times as great as the diameter WD of the filament of said coil.

2. An electric incandescent lamp according to claim 1, wherein the length CL of said coil is 18 to 36 times greater than the diameter WD of the filament of said coil, and the height H of said coil is 6 to 15 times greater than the diameter WD of the filament of said coil.

3. An electric incandescent lamp according to claim 1, wherein the length CL of said coil is 4.1 to 5.7 times greater than the outside diameter OD of said coil and the height H of said coil is 1.5 to 2.2 times greater than the outside diameter OD of said coil, and the distance A between each of the windings of the filament of said coil, measured along the mean curvature MC of said coil, is 0.4 to 1.0 times as great as the diameter WD of the filament of said coil.

4. An electric incandescent lamp according to claim 3, wherein the length CL of said coil is 20 to 33 times greater than the diameter WD of the filament of said coil, and the height H of said coil is 7 to 13 times greater than the diameter WD of the filament of said coil.

5. An electric incandescent lamp according to claim 1, wherein the length CL of said coil is 4.6 to 5.2 times greater than the outside diameter OD of said coil and the height H of said coil is 1.5 to 2.2 times greater than the outside diameter OD of said coil, and the distance A between each of the windings of the filament of said coil, measured along the mean curvature ML of said coil, is 0.5 to 0.9 times as great as the diameter WD of the filament of said coil.

6. An electric incandescent lamp according to claim 5, wherein the length CL of said coil is 4.6 to 5.2 times greater than the outside diameter OD of said coil, and the height H of said coil is 1.7 to 2.0 times greater than the outside diameter OD of said coil, and the distance A between each of the windings of the filament of said coil, measured along the mean curvature ML of said coil, is 0.5 to 0.9 times as great as the diameter WD of the filament of said coil.

7. An electric incandescent lamp according to claim 5, wherein the length CL of said coil is 21 to 30 times greater than the diameter WD of the filament of said coil and the height H of said coil is 8 to 12 times greater than the diameter WD of the filament of said coil.

8. An electric incandescent lamp according to claim 1 wherein the mean curvature ML of said coil is approximately an arc of a circle, the radius R of said circle being 2.0 to 4.0 times larger than the outside diameter OD of said coil.

9. An electric incandescent lamp according to claim 8, wherein the radius R of said circle of said coil is 2.4 to 3.7 times larger than the outside diameter OD of said coil.

10. An electric incandescent lamp according to claim 1, wherein the mean curvature ML of said coil is approximately the shape of the base portion of a parabola.

11. An electric incandescent lamp according to claim 1, wherein the mean curvature ML of said coil is approximately the shape of the base portion of an hyperbola.

12. An electric incandescent lamp according to claim 1, wherein the distance B between each of the windings of the filament of said coil measured along the inside of the curvature of said coil is 0.1 to 0.8 times as great as the diameter WD of the filament of said coil.

13. An electric incandescent lamp according to claim 12, wherein the distance B between each of the windings of the filament of said coil measured along the inside of the curvature of said coil is 0.1 to 0.5 times as great as the diameter WD of the filament of said coil.

14. An electric incandescent lamp according to claim 1, wherein the coil is located symmetrically in the axis of the lamp.

* * * * *